US010396481B2

(12) United States Patent
Lauermann

(10) Patent No.: US 10,396,481 B2
(45) Date of Patent: Aug. 27, 2019

(54) MEZZANINE ELECTRICAL CONNECTOR

(71) Applicant: FCI USA LLC, Etters, PA (US)

(72) Inventor: Mark E. Lauermann, Harrisburg, PA (US)

(73) Assignee: FCI USA LLC, Etters, PA (US)

( * ) Notice: Subject to any disclaimer, the term of this patent is extended or adjusted under 35 U.S.C. 154(b) by 25 days.

(21) Appl. No.: 15/520,790

(22) PCT Filed: Oct. 20, 2015

(86) PCT No.: PCT/US2015/056346

§ 371 (c)(1),
(2) Date: Apr. 20, 2017

(87) PCT Pub. No.: WO2016/064804

PCT Pub. Date: Apr. 28, 2016

(65) Prior Publication Data

US 2017/0317440 A1 Nov. 2, 2017

Related U.S. Application Data

(60) Provisional application No. 62/067,653, filed on Oct. 23, 2014.

(51) Int. Cl.
*H01R 13/10* (2006.01)
*H01R 12/73* (2011.01)
(Continued)

(52) U.S. Cl.
CPC ..... *H01R 12/73* (2013.01); *H01R 12/707* (2013.01); *H01R 12/716* (2013.01); *H01R 13/41* (2013.01);
(Continued)

(58) Field of Classification Search
CPC ..... H01R 12/51; H01R 12/52; H01R 12/73; H01R 12/79; H01R 12/727; H01R 11/22;
(Continued)

(56) References Cited

U.S. PATENT DOCUMENTS 3,199,066 A * 8/1965 Eledge ..... H01R 12/716 439/636
3,259,869 A * 7/1966 Batcheller ..... H01R 13/28 439/290
(Continued)

FOREIGN PATENT DOCUMENTS

CN 101006614 A 7/2007
CN 203277706 U 11/2013
(Continued)

OTHER PUBLICATIONS

International Search Report and Written Opinion for International Application No. PCT/US2015/056346 dated Jan. 28, 2016.
(Continued)

*Primary Examiner* — Edwin A. Leon
*Assistant Examiner* — Milagros Jeancharles
(74) *Attorney, Agent, or Firm* — Wolf, Greenfield & Sacks, P.C.

(57) ABSTRACT

An electrical connector assembly includes a first electrical connector and a second electrical connector configured to be mated with the first electrical connector. The first electrical connector includes a connector housing and first receptacle contacts having inner projections that secure the electrical contacts to the connector housing. The connector housing can include a plurality of divider walls that protect the mating ends of the receptacle contacts. The second electrical connector includes a second connector housing and a plurality of second electrical contacts supported by the second connector housing. The second electrical contacts can define paddle-shaped mating ends.

27 Claims, 6 Drawing Sheets

(51) Int. Cl.

| | |
|---|---|
| ***H01R 12/70*** | (2011.01) |
| ***H01R 12/71*** | (2011.01) |
| ***H01R 13/41*** | (2006.01) |
| ***H01R 24/68*** | (2011.01) |
| ***H01R 24/76*** | (2011.01) |
| *H01R 107/00* | (2006.01) |

(52) U.S. Cl.
CPC ..... *H01R 24/68* (2013.01); *H01R 24/76* (2013.01); *H01R 2107/00* (2013.01)

(58) Field of Classification Search
CPC ..... H01R 13/11; H01R 13/112; H01R 13/113; H01R 13/114; H01R 13/115; H01R 13/40; H01R 13/422; H01R 13/41
USPC ..... 439/74, 75, 76.1, 682–691, 851, 856, 439/857, 886, 260–261, 492
See application file for complete search history.

(56) References Cited

U.S. PATENT DOCUMENTS 3,411,127 A * 11/1968 Adams ..... H01R 13/28 439/290
3,865,462 A * 2/1975 Cobaugh ..... H01R 13/428 439/748
4,241,970 A * 12/1980 Rider, Jr. ..... H01R 12/675 439/403
4,740,180 A * 4/1988 Harwath ..... H01R 13/193 439/848
5,267,881 A * 12/1993 Matuzaki ..... H01R 24/62 439/660
5,290,181 A * 3/1994 Bixler ..... H01R 13/193 439/692
5,558,542 A * 9/1996 O'Sullivan ..... H01R 13/40 439/682
5,692,928 A * 12/1997 Nelson ..... H01R 13/41 439/733.1
5,795,191 A 8/1998 Preputnick et al.
5,957,734 A * 9/1999 Gladd ..... H01R 13/11 439/857
5,980,337 A * 11/1999 Little ..... H01R 13/11 439/857
6,024,584 A 2/2000 Lemke et al.
6,042,389 A * 3/2000 Lemke ..... H01R 43/0256 439/74
6,079,991 A 6/2000 Lemke et al.
6,093,035 A 7/2000 Lemke et al.
6,139,336 A 10/2000 Olson
6,146,202 A 11/2000 Ramey et al.
6,164,983 A 12/2000 Lemke et al.
6,183,268 B1 * 2/2001 Consoli ..... H01R 12/52 439/74
6,193,537 B1 * 2/2001 Harper, Jr. ..... H01R 13/28 439/291
6,247,635 B1 6/2001 Olson
6,325,644 B1 12/2001 Lemke et al.
6,358,068 B1 3/2002 Houtz
6,371,784 B1 * 4/2002 Scholz ..... H01R 13/193 439/259
6,425,785 B1 * 7/2002 Azuma ..... H01R 13/41 439/660
6,454,157 B2 9/2002 Olson
6,488,550 B1 * 12/2002 Kikuchi ..... H01R 13/112 439/857
6,565,368 B1 * 5/2003 Liao ..... H01R 13/112 439/342
6,623,284 B1 9/2003 Korsunsky
6,699,048 B2 * 3/2004 Johnson ..... H01R 43/0256 439/74
6,848,944 B2 2/2005 Evans
6,860,741 B2 * 3/2005 Ashman ..... H05K 13/0465 439/70
6,869,292 B2 3/2005 Johnescu et al.
6,872,085 B1 3/2005 Cohen et al.
6,899,547 B1 5/2005 Chang et al.
6,939,173 B1 9/2005 Elco et al.
7,059,873 B2 6/2006 Johnescu et al.
7,097,465 B1 * 8/2006 Korsunsky ..... H01R 13/40 439/74
7,214,104 B2 5/2007 Minich et al.
7,322,855 B2 * 1/2008 Mongold ..... H01R 13/6471 439/108
7,341,482 B2 3/2008 Ngo
7,371,094 B1 * 5/2008 Tokuhashi ..... H01R 13/112 439/260
7,431,616 B2 * 10/2008 Minich ..... H01R 13/514 439/607.05
D585,031 S * 1/2009 Hung ..... D13/154
7,503,773 B2 3/2009 Tokunaga
7,585,185 B2 9/2009 Obikane
7,597,581 B2 * 10/2009 Trout ..... H01R 13/633 439/474
7,632,107 B2 12/2009 Mizumura
7,766,670 B1 8/2010 Ju
7,985,079 B1 7/2011 Wilson et al.
8,257,095 B2 9/2012 Akai et al.
9,257,778 B2 2/2016 Buck et al.
9,520,661 B1 12/2016 Horning et al.
9,543,703 B2 1/2017 Horchler et al.
9,735,484 B2 * 8/2017 Brubaker ..... H01R 12/53
9,735,848 B2 * 8/2017 Saiwai ..... H04W 72/10
9,831,605 B2 11/2017 Buck et al.
9,871,323 B2 1/2018 Horchler et al.
2002/0061687 A1 5/2002 Cachina et al.
2002/0098738 A1 7/2002 Astbury, Jr. et al.
2004/0175995 A1 * 9/2004 Tsai ..... H01R 13/112 439/857
2005/0020103 A1 * 1/2005 Spink, Jr. ..... H01R 12/716 439/74
2005/0142908 A1 6/2005 Harper, Jr.
2007/0021002 A1 1/2007 Laurx et al.
2007/0155241 A1 7/2007 Lappohn
2007/0175572 A1 8/2007 Rubin et al.
2007/0224845 A1 9/2007 Becker et al.
2008/0176418 A1 7/2008 Hougham et al.
2008/0207023 A1 8/2008 Tuin et al.
2008/0311768 A1 12/2008 Hougham et al.
2009/0023311 A1 1/2009 Goodman
2009/0264023 A1 10/2009 Yi et al.
2010/0015861 A1 * 1/2010 Zhang ..... H05K 7/1007 439/733.1
2010/0055988 A1 3/2010 Shuey et al.
2010/0093232 A1 4/2010 Trout et al.
2010/0240233 A1 9/2010 Johnescu et al.
2010/0291803 A1 11/2010 Kirk
2011/0097934 A1 4/2011 Minich
2011/0117781 A1 5/2011 Stoner
2012/0077380 A1 3/2012 Minich et al.
2012/0088378 A1 4/2012 Rathburn
2012/0202363 A1 8/2012 McNamara et al.
2013/0273781 A1 10/2013 Buck et al.
2014/0017957 A1 1/2014 Horchler et al.
2014/0148022 A1 5/2014 Mongold et al.
2014/0273553 A1 * 9/2014 Heppner ..... H01R 12/7076 439/66
2016/0134057 A1 5/2016 Buck et al.
2017/0125946 A1 5/2017 Horchler et al.
2018/0241156 A1 8/2018 Huang et al.
2018/0316106 A1 11/2018 Rengarajan et al.
2018/0317335 A1 11/2018 Rengarajan et al.

FOREIGN PATENT DOCUMENTS

JP 2009-129708 A 6/2009
KR 10-2009-0029286 A 3/2009
TW 201136063 A 10/2011
WO WO 02/101882 A2 12/2002
WO WO 2006/105484 A1 10/2006

(56) References Cited

FOREIGN PATENT DOCUMENTS

| | | | |
|---|---|---|---|
| WO | WO 2008/156851 | A2 | 12/2008 |
| WO | WO 2016/064804 | A1 | 4/2016 |

OTHER PUBLICATIONS

International Preliminary Report on Patentability for International Application No. PCT/US2015/056346 dated May 4, 2017.
PCT/US2015/056346, Jan. 28, 2016, International Search Report and Written Opinion.
PCT/US2015/056346, May 4, 2017, International Preliminary Report on Patentability.
U.S. Appl. No. 13/836,610, filed Mar. 15, 2013, Buck et al.
U.S. Appl. No. 14/995,026, filed Jan. 13, 2016, Buck et al.
U.S. Appl. No. 15/402,146, filed Jan. 9, 2017, Horchler et al.
U.S. Appl. No. 15/898,098, filed Feb. 15, 2018, Huang et al.
U.S. Appl. No. 15/964,246, filed Apr. 27, 2018, Madhumitha.
U.S. Appl. No. 15/964,284, filed Apr. 27, 2018, Madhumitha.
EP 13775244.0, Feb. 28, 2019, European Examination.
PCT/US2018/029706, Aug. 10, 2018, International Search Report and Written Opinion.
PCT/US2018/029709, Aug. 16, 2018, International Search Report and Written Opinion.
European Examination for European Application No. EP 13775244.0 dated Feb. 28, 2019.
International Search Report and Written Opinion for International Application No. PCT/US2018/029706 dated Aug. 10, 2018.
International Search Report and Written Opinion for International Application No. PCT/US2018/029709 dated Aug. 16, 2018.
[No Author Listed], Gig-Array Connector System. Board/Wire-To-Board Connectors. FCI. Estimated date of publication before 2016. 5 pages.
[No Author Listed], NeXLev. High-Density Parallel Board Connector. Amphenol TCS. 2009. 2 pages.

* cited by examiner

MEZZANINE ELECTRICAL CONNECTOR

RELATED APPLICATIONS

This application is the U.S. National Stage of International Patent Application Number PCT/US2015/056346, filed Oct. 20, 2015, which claims priority to and the benefit of U.S. Provisional Patent Application No. 62/067,653, filed Oct. 23, 2014. The entire contents of the foregoing are hereby incorporated herein by reference.

BACKGROUND

Electrical connectors typically include a dielectric connector housing and a plurality of electrical contacts supported by the connector housing. Physical characteristics of the electrical contacts and/or the connector housing can typically govern signal integrity (SI) performance of the electrical connector. For example, mezzanine electrical connectors can be constructed with arrays of electrical contacts having fusible elements, and can be referred to as ball grid array (BGA) connectors. A pair of complementary mezzanine BGA connectors can define a stack height when mated to one another. A mezzanine BGA connector having a shorter stack height than that of typical mezzanine BGA connectors can exhibit enhanced SI characteristics relative to typical mezzanine BGA connectors. As the connector housing and the associated electrical contacts become smaller and smaller, contact retention becomes increasingly more difficult.

SUMMARY

In one embodiment, an electrical contact can include a lead portion, a mounting end that extends from the lead portion in a first transverse direction along a transverse direction, and a mating end that extends from the lead portion in a second transverse direction that is opposite the first transverse direction. The mating end can include first and second arms that are spaced from each other along a lateral direction that is perpendicular to the transverse direction. The mating end can define a first projection that extends from the first arm in a first lateral direction along the lateral direction, and a second projection that extends from the second arm in a second lateral direction that is opposite the first lateral direction. The first and second projections can be sized and configured so as to engage a dielectric connector housing so as to secure the electrical contact in the connector housing.

BRIEF DESCRIPTION OF THE DRAWINGS

The foregoing summary, as well as the following detailed description of example embodiments of the application, will be better understood when read in conjunction with the appended drawings, in which there is shown in the drawings example embodiments for the purposes of illustration. It should be understood, however, that the application is not limited to the precise arrangements shown. In the drawings.

DETAILED DESCRIPTION

Figure 1A:
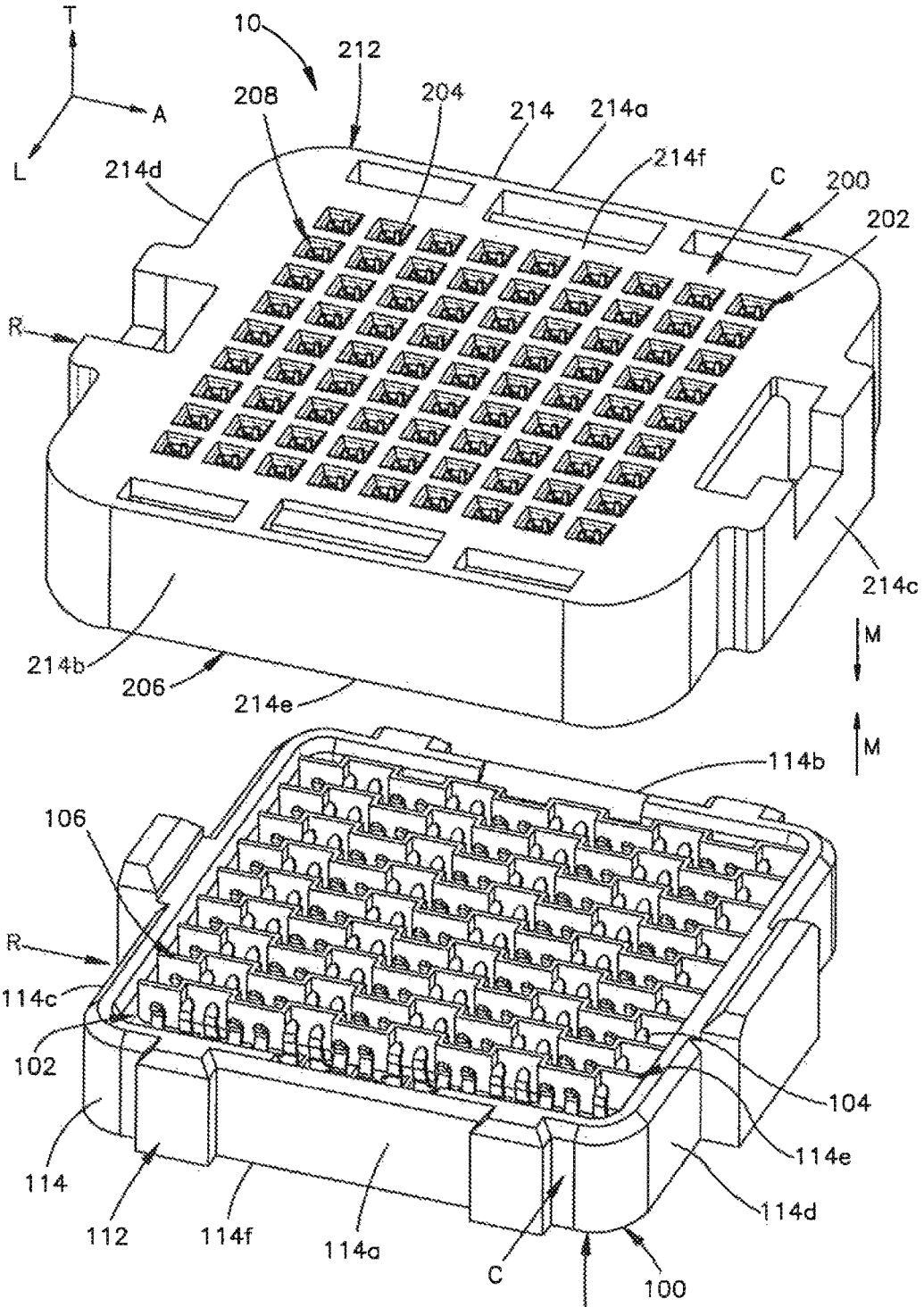
FIG. 1A is a perspective view of an electrical connector assembly constructed in accordance with one embodiment, including first and second electrical connectors configured to be mounted onto respective first and second printed circuit boards, and shown aligned to be mated with each other.
Figure 1B:
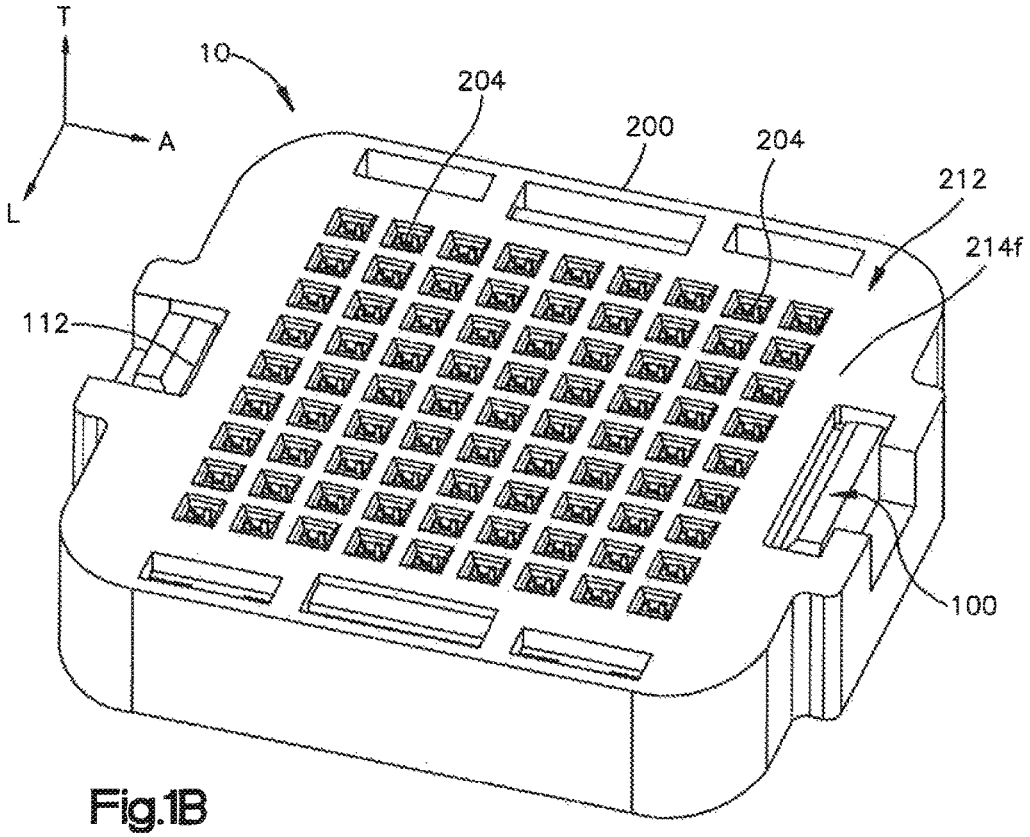
FIG. 1B is a perspective view of the first and second electrical connectors illustrated in FIG. 1A, shown mated to each other.

Referring initially to FIGS. 1A-1B, an electrical connector assembly 10 includes a first electrical connector 100 and a second electrical connector 200 that is configured to be mated to the first electrical connector 100 so as to place the first and second electrical connectors in electrical communication with each other. The first and second electrical connectors 100 and 200 can include respective alignment members that engage each other when the first and second electrical connectors 100 and 200 are mated, so as to at least partially align respective electrical contacts 104 and 204 of the first and second electrical connectors 100 and 200, respectively, with respect to each other and to ensure proper orientation of the first and second electrical connectors 100 and 200 with respect to each other during mating of the electrical connectors.

The first electrical connector 100 can include a first array 102 of electrical contacts 104. The first electrical connector 100 can include a connector housing 112, which can be referred to as a first connector housing, that is configured to support the first array 102 of electrical contacts 104, which can be referred to as a first plurality of electrical contacts 104. The connector housing 112 can be made of any suitable dielectric material, such as plastic and the electrical contacts 104 can be made of any suitable electrically conductive material, such as metal. In accordance with the illustrated embodiment the electrical contacts 104 can be stitched into the connector housing 112 or otherwise supported by the connector housing 112 as desired. Alternatively, the connector housing 112 can be overmolded onto the electrical contacts 104. The connector housing 112 can include a housing body 114 that defines opposed first and second sides 114*a* and 114*b* that are spaced from each other along a first or longitudinal direction L, opposed third and fourth sides 114*c* and 114*d* that are spaced from each other along a second or lateral direction A that extends substantially perpendicular to the longitudinal direction L, an inner end 114*e* that defines a mating interface 106, and an outer end 114*f* that is spaced from the inner end 114*e* along a third or transverse direction T and defines an opposed mounting interface 108. The first electrical connector 100 is configured to be mounted to an underlying substrate, for instance a first printed circuit board (PCB), at the mounting interface 108 such that the first electrical connector 100 is placed in electrical communication with the first printed circuit board. The mounting interface 108 can be opposite the mating interface 106 along the transverse direction T.

The transverse direction T extends substantially perpendicular to both the longitudinal direction L and the lateral direction A. It should be appreciated that in accordance with the illustrated embodiment, the longitudinal direction L and the lateral direction A are oriented horizontally, and the transverse direction T is oriented vertically, though it should be appreciated that the orientation of the first electrical connector 100, and thus the electrical connector assembly 10, can vary during use. Unless otherwise specified herein, the terms "lateral," "laterally," "longitudinal," "longitudinally," "transverse," and "transversely" are used to designate perpendicular directional components in the drawings to which reference is made.

Similarly, the second electrical connector 200 can include a connector housing 212, which can be referred to as a second connector housing, that is configured to support the second array 202 of electrical contacts 204, which can be referred to as a second plurality of electrical contacts. The connector housing 212 can be made of any suitable dielectric material, such as plastic and the electrical contacts 204 can be made of any suitable electrically conductive material, such as metal. In accordance with the illustrated embodiment the electrical contacts 204 can be stitched into the connector housing 212 or otherwise supported by the connector housing 212 as desired. Alternatively, the connector housing 212 can be overmolded onto the electrical contacts 204. The connector housing 212 can include a housing body 214 that defines opposed first and second sides 214*a* and 214*b* that are spaced from each other along a first or longitudinal direction L, opposed third and fourth sides 214*c* and 214*d* that are spaced from each other along a second or lateral direction A that extends substantially perpendicular to the longitudinal direction L, an inner end 214*e*, and an outer end 214*f* that is spaced from the inner end 214*e* along a third or transverse direction T that extends substantially perpendicular to both the longitudinal direction L and the lateral direction A. The inner end 214*e* can define the mating interface 206, and the outer end 214*f* can define the mounting interface 208. The mounting interface 208 can be opposite the mating interface 206 along the transverse direction T.

Because the mating interface 106 of the first electrical connector 100 and the mating interface 206 of the second electrical connector 200, respectively, are oriented substantially parallel to the respective mounting interfaces 108 and 208, the first and second electrical connectors 100 and 200 can be referred to as vertical or mezzanine electrical connectors. However it should be appreciated that one or both of the first and second electrical connectors 100 and 200 can be otherwise constructed as desired, for instance as right-angle electrical connectors such that the respective mating interfaces are oriented substantially perpendicular to the respective mounting interfaces.

The second electrical connector 200 can be configured to be mounted to an underlying substrate, for instance a second printed circuit board (PCB), at the mounting interface 208 such that the second electrical connector 200 is placed in electrical communication with the second printed circuit board. When the first and second electrical connectors 100 and 200 are mated to each other, such that the mating interface 106 of the first electrical connector 100 engages with the mating interface 206 of the second electrical connector 200 to place the respective arrays of electrical contacts 104 and 204 in electrical communication with each other, the first and second electrical connectors 100 and 200 can operate to place the first printed circuit board in electrical communication with the second printed circuit board. Thus, an electrical connector system can include the electrical connector assembly 10, including the first and second electrical connectors 100 and 200, mounted onto the respective printed circuit boards.

Further in accordance with the illustrated embodiment, the electrical contacts 104 of the first array 102 of electrical contacts 104 are arranged into at least two such as a plurality of rows that extend along a row direction R that can be defined by the lateral direction A and into at least two such as a plurality of columns that extend substantially perpendicular to the rows along a column direction C that can be defined by the longitudinal direction L. As illustrated, each row or electrical contacts 104 can intersect with every column of electrical contacts 104, and each column of electrical contacts can intersect with every row of electrical contacts 104. In this regard, it can be said that each of the at least two rows of electrical contacts 104 intersects each of the at least two columns of electrical contacts 104. Similarly, in accordance with the illustrated embodiment, the electrical contacts 204 of the second array 202 of electrical contacts 204 are arranged into at least two such as a plurality of rows that extend along a row direction R that can be defined by the lateral direction A and into at least two such as a plurality of columns that extend substantially perpendicular to the rows along a column direction C that can be defined by the longitudinal direction L. As illustrated, each row or electrical contacts 204 can intersect with every column of electrical contacts 204, and each column of electrical contacts can intersect with every row of electrical contacts 204. In this regard, it can be said that each of the at least two rows of electrical contacts 204 intersects each of the at least two columns of electrical contacts 204.

Figure 2A:
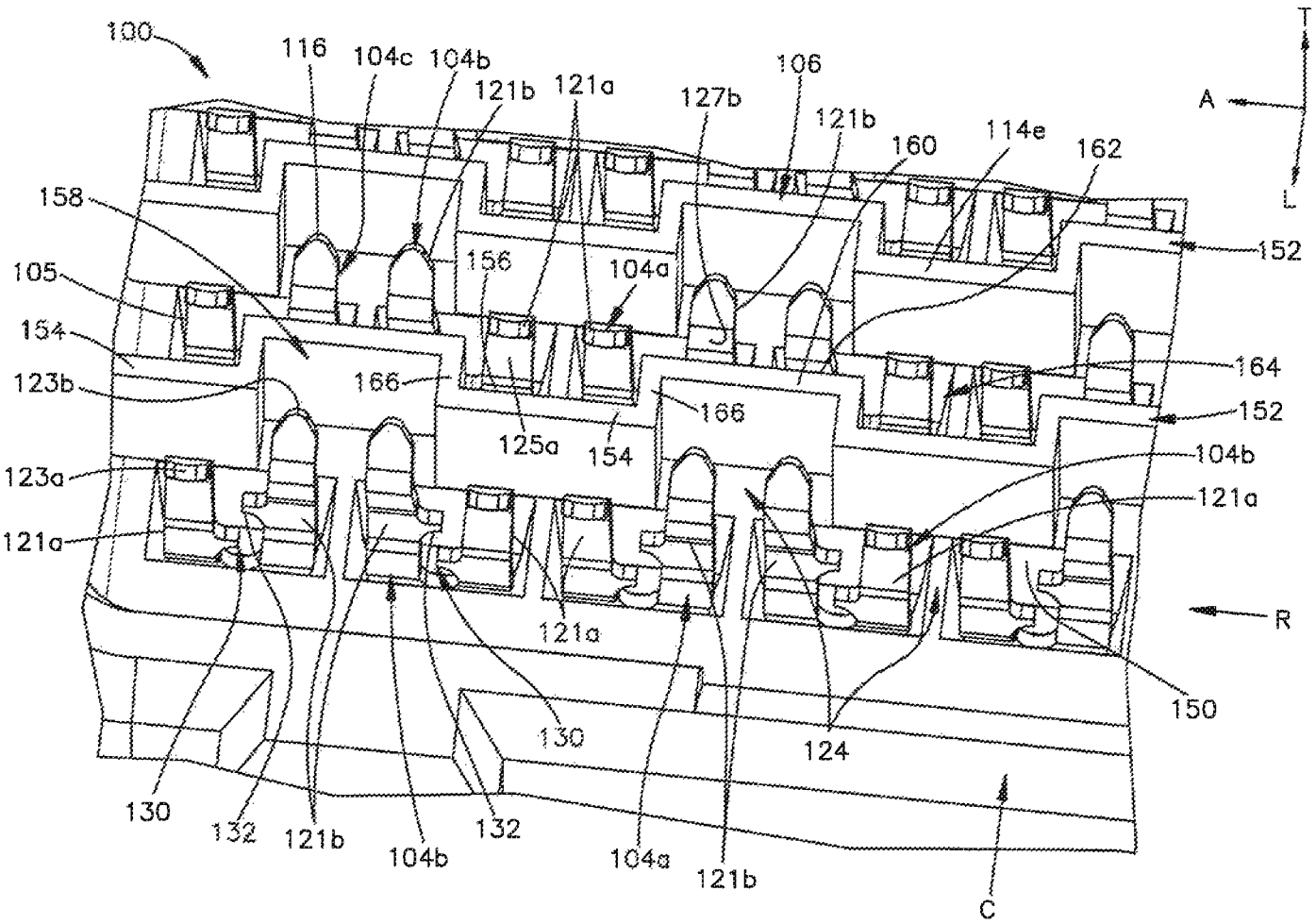
FIG. 2A is an enlarged perspective view of a portion of the first electrical connector illustrated in FIG. 1A, including a connector housing and a plurality of electrical contacts supported by the connector housing.
Figure 2B:
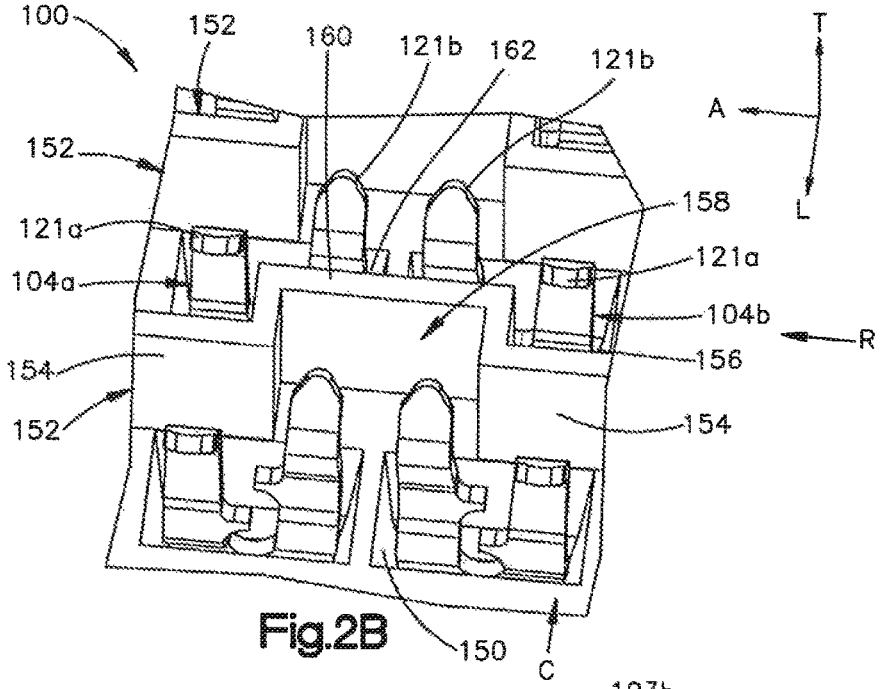
FIG. 2B is a further enlarged perspective view of a portion of the first electrical connector illustrated in FIG. 2A.
Figure 3A:
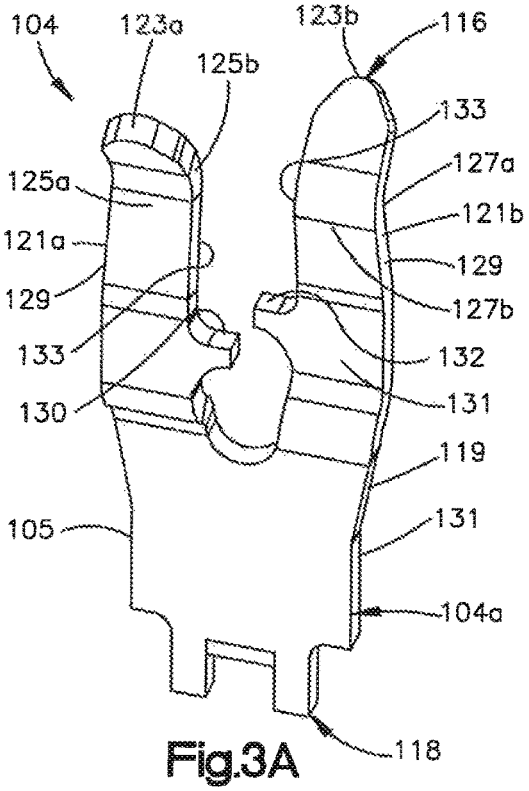
FIG. 3A is a perspective view of one of the electrical contacts illustrated in FIG. 2A in accordance with one embodiment.
Figure 3B:
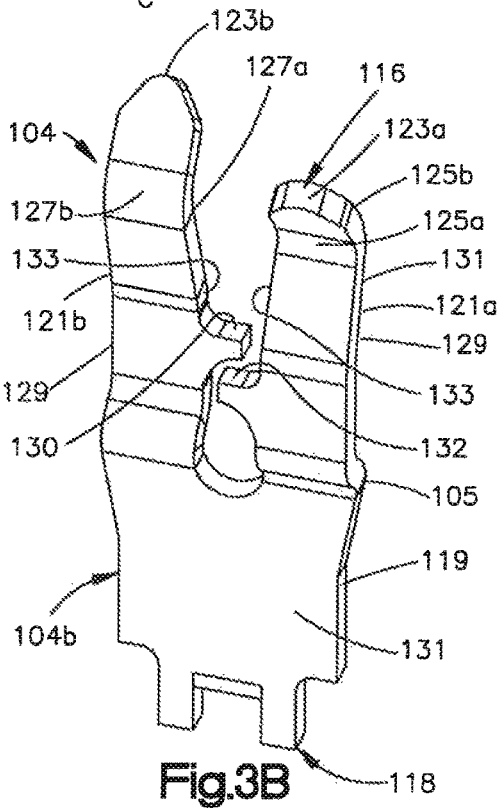
FIG. 3B is a perspective view of one of the electrical contacts illustrated in FIG. 2A in accordance with another embodiment.

Referring now also to FIGS. 2A and 3A-3B, each electrical contact 104 can have a contact body 105 that defines a mating end 116, an opposed mounting end 118 that extends out from the mounting interface 108, and a lead portion 119 that extends between the mating end 116 and the mounting end 118. Thus, the mounting end 118 can extend from the lead portion 119 along a first or inner transverse direction along the transverse direction T, and the mating end 116 can extend from the lead portion 119 along a second or outer transverse direction along the transverse direction T that is opposite the first transverse direction. The mating end 116 and the mounting end 118 can be spaced from each other, or opposite each other, along the transverse direction T. At least a portion of the contact body 105 of each electrical contact 104 can be curved between the mating and mounting ends 116 and 118, respectively, as it extends between the mating end 116 and the mounting end 118 along the transverse direction T. In accordance with one embodiment, each contact body can include first and second arms 121*a* and 121*b* that extend from the lead portion 119 away from the mounting end 118 to respective tips 123*a* and 123*b*. Each of the tips 123*a* and 123*b* can be tapered along the lateral direction A. For instance, each of the tips 123*a* and 123*b* can define opposed surfaces that converge toward each other at a slope greater than remaining opposed surfaces of the respective electrical contacts 104 at a location between the lead portions 119 and the tips 123*a* and 123*b*, respectively. The converging surfaces can be opposed edges that are oriented to face the row direction R, or the lateral direction A. The first and second arms 121*a* and 121*b* of each electrical contact 104 can combine to define the mating end 116 of the electrical contact 104. The first and second arms 121*a* and 121*b* can be spaced from each other along the row direction R. Thus, the first and second arms 121*a* and 121*b* can be spaced from each other along the lateral direction A.

At least a portion of each of the electrical contacts 104, for instance the mating end 116, can define a pair of opposed outer edges 129 and a pair of opposed broadsides 131 that are longer than the opposed edges in a plane that is orthogonal to the electrical contact. The outer edges 129 can face the row direction R, and the broadsides 131 can face the column direction C. Thus, the outer edges 129 can face the lateral direction A, and the broadsides 131 can face the longitudinal direction L. The electrical contacts 104 of the first array 102 can be configured as edge-coupled. For instance, adjacent ones of the electrical contacts 104 can define pairs along the row direction R. Thus, a plurality of pairs of electrical contacts 104 can be defined along the row direction. The outer edges 129 of each of the electrical contacts 104 in each of the rows can face the outer edges 129 of adjacent ones of the electrical contacts 104 disposed in the respective each of the rows.

Each contact body 105 can define a region of curvature. The region of curvature can be defined by each of the first and second arms 121*a* and 121*b*. For instance, each of the first arms 121*a*, for example at the mating ends 116, can define a first concave surface 125*a* and a first convex surface 125*b* opposite the first concave surface 125*a* along the column direction C. Thus, the first convex surface 125*b* can be opposite the first concave surface 125*a* along the longitudinal direction L. For instance, the first concave surface 125*a* can face a first longitudinal direction along the column or longitudinal direction L, and the first convex surface 125*b* can face a second longitudinal direction along the column or longitudinal direction L that is opposite the first longitudinal direction. Similarly, each of the second arms 121*b*, for example at the mating ends 116, can define a second concave surface 127*a* and a second convex surface 127*b* opposite the second concave surface 127*a* along the column direction C. Thus, the second convex surface 127*b* can be opposite the second concave surface 127*a* along the longitudinal direction L. As will be described in more detail below, the electrical contacts 204 can be received between the first and second arms 121*a* and 121*b* of respective ones of the electrical contacts 104, such that a first surface of the electrical contacts 204 is in physical contact with the first convex surface 125*b*, and a second surface of the electrical contacts 204 opposite the first surface of the electrical contacts 204 is in physical contact with the second convex surface 127*b*. Thus, the first and second convex surfaces 125*b* and 127*b* of each of the first electrical contacts 104 can define contact surfaces that are configured to contact respective opposed surfaces of respective ones of the second electrical contacts 204 when the first and second electrical connectors 100 and 200 are mated with each other.

The first concave surface 125*a* can be oriented opposite the second concave surface 127*a*, and the first convex surface 125*b* can be oriented opposite the second convex surface 127*b*. For instance, the first concave surface 125*a* can face a first longitudinal direction along the column or longitudinal direction L, and the first convex surface 125*b* can face a second longitudinal direction along the column or longitudinal direction L that is opposite the first longitudinal direction. Similarly, the second concave surface 127*a* can face the second longitudinal direction along the column or longitudinal direction L, and the second convex surface 127*b* can face the first longitudinal direction along the column or longitudinal direction L. Thus, it can be said that the first and second arms 121*a* and 121 *b* are bent in opposite directions at the mating ends 116. The first arms 121*a* of each of the electrical contacts 104 can be bent in a common first longitudinal direction along the longitudinal direction L, and the second arms 121*b* of each of the electrical contacts 104 can be bent in a common second longitudinal direction that is opposite the common first longitudinal direction. Accordingly, the first arms 121*a* of all of the electrical contacts 104 that are disposed in a respective one of the rows can be aligned with each other. Similarly, the second arms 121*b* of all of the electrical contacts 104 that are disposed in the respective one of the rows can be aligned with each other.

Further, it should be appreciated that ones of the electrical contacts 104 that are disposed in a respective one of the rows can define first and second ones 104*a* and 104*b*, respectively, electrical contacts of the plurality of electrical contacts 104. The second arm 121*b* of the first one 104*a* of the electrical contacts 104 can be disposed adjacent the second arm 121*b* of the second one 104*b* of the electrical contacts 104 along the row direction R. The first and second ones 104*a* and 104*b* of the electrical contacts 104 can be adjacent each other along the row so as to define a pair of the electrical contacts 104. Accordingly, the second arms 121*b* of the first and second ones 104*a* and 104*b* of the electrical contacts 104 that define a pair of adjacent electrical contacts 104 in a first lateral direction along the row or lateral direction L can be disposed between the first arms 121*a* of the first and second ones 104*a* and 104*b* of the electrical contacts of the pair. Accordingly, it can be said that the first and second ones 104*a* and 104*b* of the electrical contacts 104 of the pair can be edge coupled at the first arms 121*a*. That is, the outer edge 129 of each of the first ones 104*a* of the electrical contact 104 at the second arm 121*b* of a respective given pair in the first lateral direction can face, and can be aligned with and face the outer edge 129 of the second arm 121*b* of the second one 104*b* of the electrical contact 104 of the respective pair.

It should be appreciated that a plurality of pairs of the electrical contacts 104 extend along the row direction R of each of the rows of the first electrical connector 100. Accordingly, the first and second ones 104*a* and 104*b* of the electrical contacts 104 can be alternatingly arranged along the row direction, with adjacent ones of the electrical contacts 104 defining a pair. Thus, it should be appreciated that the first arm 121*a* of the first one 104*a* of the electrical contacts 104 can be disposed adjacent the first arm 121*a* of a third one 104*c* of the electrical contacts 104 in a second lateral direction opposite the first lateral direction. The third one 104*c* of the electrical contacts 104 can be defined by a second one 104*b* of the electrical contacts of an adjacent pair of the electrical contacts 104 in the second lateral direction. Thus, the first and second ones 104*a* and 104*b* can be alternatingly arranged along each of the respective rows. Further, the first arms 121*a* of the first and third electrical contacts 104*a* and 104*c* that define a pair of adjacent electrical contacts 104 in the second lateral direction along the row direction R can be disposed between the second arms 121*b* of the first and third ones 104*a* and 104*c* of the electrical contacts 104 of the pair. Further, the first and third ones 104*a* and 104*c* of the electrical contacts 104 of the pair can be edge coupled at the first arms 121*a*. That is, the outer edge 129 of the first arm 121*a* of each of the first ones 104*a* of the electrical contacts of a respective given pair can face, and can be aligned with, the outer edge 129 of the first arm

121*a* of the third one 104*c* of the electrical contacts of the respective pair. Accordingly, the second arms 121*b* of a first pair of adjacent ones of the electrical contacts 104 adjacent each other in the first lateral direction can be aligned with each other and face each other along the lateral direction. Further, the first arms 121*a* of a second pair of adjacent ones of the electrical contacts 104 adjacent each other in the second lateral direction can be aligned with each other and face each other along the lateral direction A.

The outer edges 129 can be substantially planar along a plane that includes the transverse direction T and the longitudinal direction L, such that the electrical contacts 104 are better impedance matched with the electrical contacts 204 to which they are mated, with respect to conventional mezzanine electrical connectors. Similarly, the outer edges 129 of the first arms 121*a* of first and third ones 104*a* and 104*c* of the electrical contacts 104 at the respective mating ends 116 at a location between the lead portion 119 and the tips 123*a* do not define two points that are offset along the row direction R, or lateral direction A, more than The first arm 121*a* of at least one up to all of the electrical contacts 104 can include a first projection 130. Similarly, the second arm 121*b* of at least one up to all of the electrical contacts 104 can include a second projection 132. The first and second projections 130 and 132 can be monolithic with each other when the electrical contacts 104 are initially stamped, and can be subsequently broken when the first and second arms 121*a* and 121*b* are bent as described above. The first and second projections 130 and 132 are configured to be engaged by an instrument that inserts the respective electrical contact 104 into the connector housing 112. For instance, the first and second projections 130 and 132 can define respective transverse facing surfaces that can receive an insertion force along the transverse direction that inserts the electrical contact 104 into the connector housing 112, such that the electrical contact 104 is supported by the connector housing 112 in the manner described herein. Alternatively or additionally, each of the first and second projections 130 and 132 can define opposed surfaces that can be grabbed by an insertion instrument that then applies the insertion force to the corresponding electrical contact.

The first projection 130 can extend out from an edge of the first arm 121*a* along a first projection direction. The first projection direction 130 can be along the row direction R, or lateral direction A. The edge of the first arm 121*a* can be an inner edge 133 that is opposite the outer edge 129 at the first arm 121*a*. Further, the first projection direction can be in the first lateral direction. Similarly, the second projection 132 can extend out from an edge of the second arm 121*b* along a second projection direction. The second projection direction can be along the row direction R, or lateral direction A. The edge of the second arm 121*b* can be an inner edge 133 that is opposite the outer edge 129 of the electrical contacts 104 at the second arm 121*b*. Further, the second projection direction can be in the second lateral direction. The first and second projection directions can thus be oriented opposite and toward each other. The first and second projections 130 and 132 extend out from the first and second arms 121*a* and 121*b*, respectively, an equal distance along the lateral direction A.

At least a portion up to an entirety of the first and second projections 130 and 132 can be offset with respect to each other along the column direction C, or longitudinal direction L. Moreover, at least a portion up to an entirety of the first and second projections 130 and 132 can be offset with respect to each other along the transverse direction T. For instance, in one example, the first projection 130 can define a first distance to the mating interface 106, and the second projection 132 can define a second distance to the mating interface 106 that is less than the first distance. Alternatively, the second distance can be greater than the first distance. It should be appreciated that the first and second ones 104*a* and 104*b* of the electrical contacts 104 can be symmetrical with respect to each other about a plane that is disposed between the first and second ones 104*a* and 104*b* of the electrical contacts 104 with respect to the row direction, and oriented in the longitudinal direction L and the transverse direction T. Further, it should be appreciated that the first and third ones 104*a* and 104*c* of the electrical contacts 104 can be symmetrical with respect to each other about a plane that is disposed between the first and third ones 104*a* and 104*c* of the electrical contacts 104 with respect to the row direction, and oriented in the longitudinal direction L and the transverse direction T. Thus, the edges of repeating first and second ones 104*a* and 104*b* of the electrical contacts 104 can be aligned with each other, such that the electrical contacts 104 define alternating mirror images of each other along the row.

Referring now to FIG. 1A and FIGS. 4-5A, the electrical contacts 204 of the second electrical connector 200 can each have a second contact body 205 that defines a mating end 216, an opposed mounting end 218 that extends out from the mounting interface 208, and a lead portion 219 that extends between the mating end 216 and the mounting end 218. Thus, the mounting end 218 can extend from the lead portion 119 along a first or inner direction along the transverse direction T, and the mating end 216 can extend from the lead portion 119 along a second or outer direction along the transverse direction T that is opposite the first direction. Each of the electrical contacts 204 can further define an aperture 246 that extends through the lead portion 219. The aperture 246 can be configured to receive a portion of the connector housing 212 so as to secure the electrical contacts 204 in the connector housing 212 when the electrical contacts 204 are inserted into the connector housing 212 along the transverse direction T. Further, the aperture 246 can prevent solder wicking during attachment of the respective mounting ends to the solder balls, as described in more detail below.

The mating end 216 and the mounting end 218 can be spaced from each other, or opposite each other, along the transverse direction T. At least a portion of each of the electrical contacts 204, for instance the mating end 216, can define a pair of opposed edges 240 and a pair of first and second opposed broadsides 242*a* and 242*b* that are longer than the opposed edges in a plane that is orthogonal to the electrical contact. The first and second broadsides 242*a* and 242*b* face opposite directions along the longitudinal direction L when supported by the second connector housing 212. The edges can face the row direction R, and the broadsides can face the column direction C. Thus, the edges can face the lateral direction A, and the broadsides can face the longitudinal direction L. The electrical contacts 104 of the first array 102 can be configured as edge-coupled. For instance, adjacent ones of the electrical contacts 104 can define pairs along the row direction R. Thus, a plurality of pairs of electrical contacts 104 can be defined along the row direction. The edges of each of the electrical contacts 104 in each of the rows can face the edges of adjacent ones of the electrical contacts 104 disposed in the respective each of the rows.

When the electrical contacts 204 are mated with the electrical contacts 104, one of the broadsides 242*a*-*b* can contact the contact surface defined by one of the first and second convex surfaces 125*b* and 127*b* of the respective electrical contact 104, and the other of the broadsides can contact the other of the first and second convex surfaces 125*b* and 127*b* of the respective electrical contact 104. Thus, the electrical contacts 204 can be referred to as header contacts, or plug contacts, and the electrical contacts 104 can be referred to as receptacle contacts. The mating ends of the receptacle contacts receive the mating ends of the header contacts when the first and second electrical connectors 100 and 200 are mated with each other, which causes the first electrical contacts 104 to mate with complementary ones of the second electrical contacts 204.

The mounting end 218 extends out from the lead portion 219 in a first direction along the transverse direction T, and the mating end 216 extends out from the lead portion 219 in a second direction along the transverse direction T opposite the first direction. The mounting end 218 (and the mounting end 118) can define at least one projection 244 that extends out from the lead portion 219. For instance, the mounting end 218 can include a pair of projections 244 spaced from each other along the lateral direction A. At least a portion of the projections 244 of each electrical contact 204 can further be offset from each other in the longitudinal direction L. Similarly, the mounting end 118 can define at least one projection that extends out from the lead portion 119. For instance, the mounting end 118 can include a pair of projections spaced from each other along the lateral direction A. At least a portion of the projections of each electrical contact 104 can further be offset from each other in the longitudinal direction L.

The mating end 216 can be generally paddle shaped. Further, the electrical contacts 204 can be configured as blades. For instance, the broadsides 242*a-b* of the electrical contacts 204 can be substantially planar along a plane that is defined by the transverse direction T and the lateral direction A. At least a portion up to an entirety of the edges 240 at the mating end 216 can flare away from each other as they extend in an outward transverse direction. The outward transverse direction is along the transverse direction T from the mounting end 218 toward the mating end 216. It is appreciated that the edges 240 at the mating end 216 can define a first or inner transverse portion 240*a* and a second or outer transverse portion 240*b* that is spaced from the inner transverse portion 240*a* in the outer transverse direction. The inner transverse portions 240*a* of the opposed edges 240 can flare away from each other, and thus diverge from each other, as they extend in the outer transverse direction. The outer transverse portions 240*b* can diverge from each other an amount less than an amount that the inner transverse portions 240*a* diverge from each other. Alternatively, the outer transverse portions 240*b* can be parallel to each other, and can be oriented along the transverse direction T.

The first and second connector housings 112 and 212 will now be described. Referring now to FIGS. 1A and 2A, the connector housing 112 can include a base 150 that defines the mounting interface 108, and a plurality of divider walls 152 that project from the base 150 in an outer transverse direction so as to define the mating interface 106. The outer transverse direction can also be defined as a direction from the mounting ends 118 toward the mating ends 116 in the transverse direction T. The outer transverse direction can also be defined as a direction from the mounting interface 108 to the mating interface 106. The divider walls 152 can be monolithic with the base 150, or alternatively attached to the base 150 in any manner as desired. The divider walls 152 are spaced from each other along the longitudinal direction L. The divider walls can further separate adjacent ones of the rows of the first electrical connector 100 from each other. Each of the divider walls 152 can include a plurality of first wall segments 154. Each first wall segment 154 can be substantially planar along a respective first plane defined by the transverse direction T and the lateral direction A.

Each of the first wall segments 154 can define a first surface 156 that, in turn, can be planar along the respective first plane. The first surface 156 can face the first arms 121*a* of first and second ones 104*a* and 104*b* of the first electrical contacts 104 that define a respective first pair of adjacent ones of the first electrical contacts 104 along the lateral direction A. For instance, the first surface 156 and the first concave surfaces 125*a* of the first arms 121*a* can face a direction toward each other. In one example, the first surface 156 and the first concave surfaces 125*a* of the first arms 121*a* can face each other. In another example, the first surface 156 and the first concave surfaces 125*a* of the first arms 121*a* can be offset with respect to each other along the transverse direction T. For instance, the first concave surfaces 125*a* can be offset with respect to the first surface 156 in the outer transverse direction T. At least a portion up to an entirety of the mating ends 116 can project out with respect to the divider walls 152 in the outer transverse direction T. Alternatively, the tips 123*a* and 123*b* and outermost ends of the divider walls 152 can be coplanar with each other along a plane that is defined by the lateral direction A and the longitudinal direction L. Alternatively, the tips 123*a* and 123*b* can be recessed inwardly in the transverse direction T toward the base 150 with respect to the outermost ends of the divider walls 152. Thus, the divider walls 152 can provide physical protection to the electrical contacts 104. The first surfaces 156, and thus the first wall segments 154, of a respective one of the rows can all be aligned with each other in the lateral direction A along the respective first plane. The connector housing 112 can define gaps 158 between adjacent ones of the first wall segments 154 along the lateral direction A. It is recognized that the divider walls 152 can provide dielectric properties for increased signal integrity as desired.

Each of the divider walls 152 can further include a plurality of second wall segments 160 connected between respective adjacent ones of the first wall segments 154. The second wall segments 160 can be offset with respect to the first wall segments 154 along the longitudinal direction. Each second wall segment 160 can be substantially planar along a respective second plane defined by the transverse direction T and the lateral direction A. Thus, the respective second plane can be parallel to the respective first plane, and spaced from the respective first plane along the longitudinal direction L. Each of the second wall segments 160 can define a second surface 162 that, in turn, can be planar along the respective second plane. The second surface 162 can face the second arms 121*b* of first and second ones 104*a* and 104*b* of the first electrical contacts 104 that define a respective second pair of adjacent ones of the first electrical contacts 104 along the lateral direction A. The second pair of electrical contacts 104 whose second arms 121*b* are aligned with the second surface 162 can include an electrical contact common with the first pair of electrical contacts 104 whose first arms 121*a* are aligned with the first surface 156. For instance, the second pair of electrical contacts can include one of the first and second ones 104*a* and 104*b* of the electrical contacts 104 and a third one 104*c* of the electrical contacts 104.

In one example, the second surface 162 and the second convex surfaces 127*b* of the second arms 121*b* can face a direction toward each other. In one example, the second surface 162 and the second convex surfaces 127*b* of the second arms 121*b* can face each other. In another example, the second surface 162 and the second convex surfaces 127*b* of the second arms 121*b* can be offset with respect to each other along the transverse direction T. For instance, the second convex surfaces 127*b* can be offset with respect to the second surface 162 in the outer transverse direction T. The second surface 162 can be disposed between the first arms 121*a* and the first surfaces 156 with respect to the longitudinal direction L. Further, the second surfaces 162 can be disposed between at least a portion up to an entirety of the second arms 121*b* and at least a portion up to an entirety of the first arms 121*a* of the electrical contacts 104 with respect to the longitudinal direction L. The first surfaces 156 can be disposed such that the second surfaces 162 are disposed between the second arms 121*b* and the first surfaces 156 with respect to the longitudinal direction L. Further, the first arms 121*a* can be disposed between the first wall segments 154 and the second wall segments 160 with respect to the longitudinal direction L along a respective one of the rows. The second surfaces 162, and thus the second wall segments 160 of a respective one of the rows can all be aligned with each other in the lateral direction A along the respective second plane. The connector housing 112 can define gaps 164 between adjacent ones of the second wall segments 160 along the lateral direction A.

Each of the divider walls 152 can further include a plurality of ribs 166 that are connected between a respective one of the first wall segments 154 and a respective one of the second wall segments 160. For instance, each of the first wall segments 154 and the second wall segments 160 can define a first end that is disposed closer to the third side 114*c* than the fourth side 114*d* along the lateral direction A. Each of the first wall segments 154 and the second wall segments 160 can further define a second end opposite the first end. Thus, the second ends can be disposed closer to the fourth side 114*d* than the third side 114*c* along the lateral direction A. Each of the ribs 166 can extend from the first end of one of the first and second wall segments 154 and 160 to the second end of the other of the first and second wall segments 154 and 160. For instance, a first plurality of the ribs 166 can extend from the first end of a respective one of the first wall segments 154 to the second end of a respective one of the second wall segments 160. A second plurality of the ribs 166 can extend from the second end of a respective one of the first wall segments 154 to the first end of a respective one of the second wall segments 160. The first ends of the first wall segments 154 can be aligned with the second ends of the second wall segments 160 with respect to the longitudinal direction L. Similarly, the second ends of the first wall segments 154 can be aligned with the first ends of the second wall segments 160 with respect to the longitudinal direction. Accordingly, each of the ribs 166 can be oriented along the longitudinal direction. For instance, each of the ribs 166 can lie in a respective plane that is defined by the transverse direction T and the longitudinal direction L. Each of the divider walls 152 can be coplanar with each other at their outermost transverse surfaces.

Figure 4:
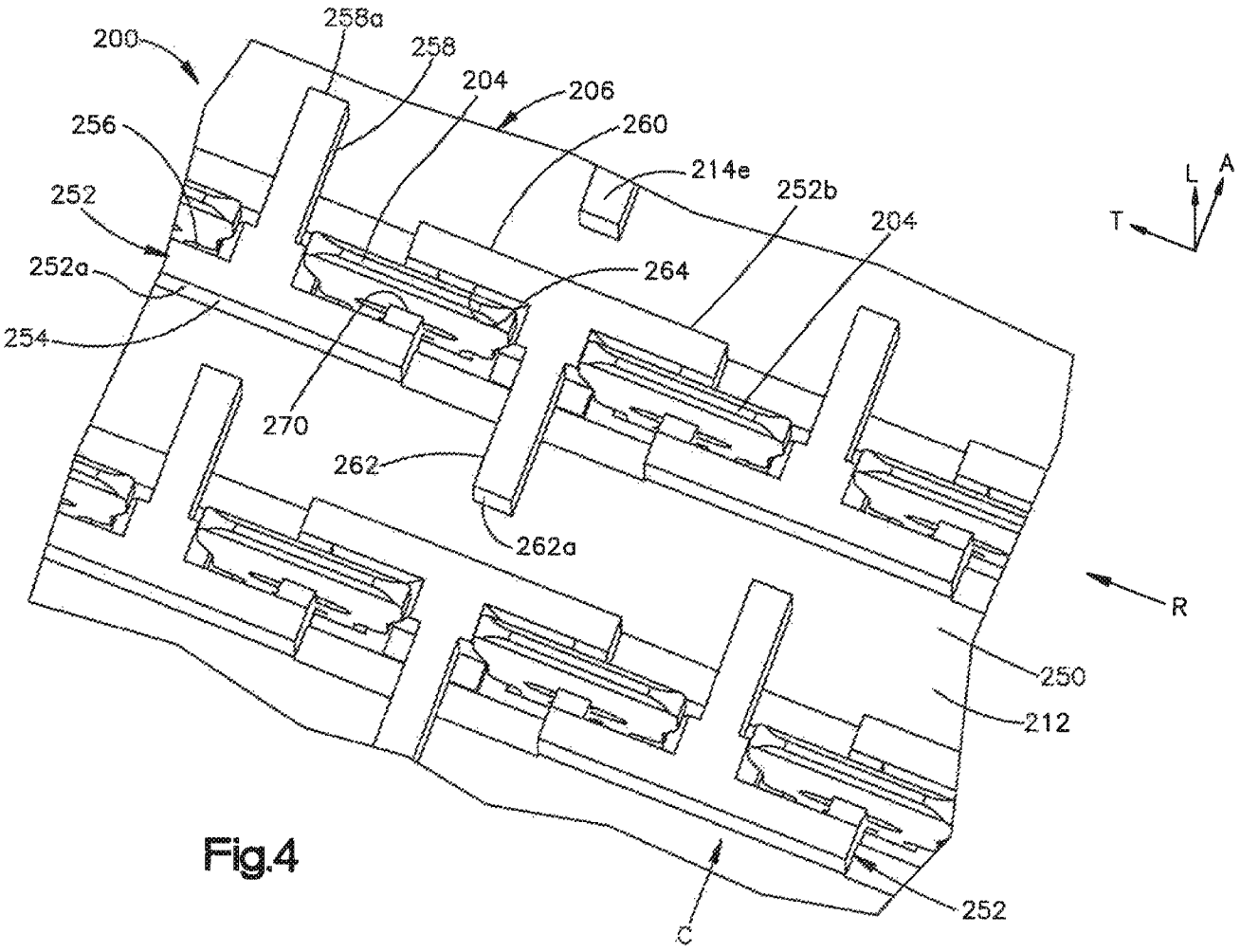
FIG. 4 is a perspective view of an enlarged portion of the second electrical connector illustrated in FIG. 1A, including a connector housing and a plurality of electrical contacts supported by the connector housing.
Figure 5A:
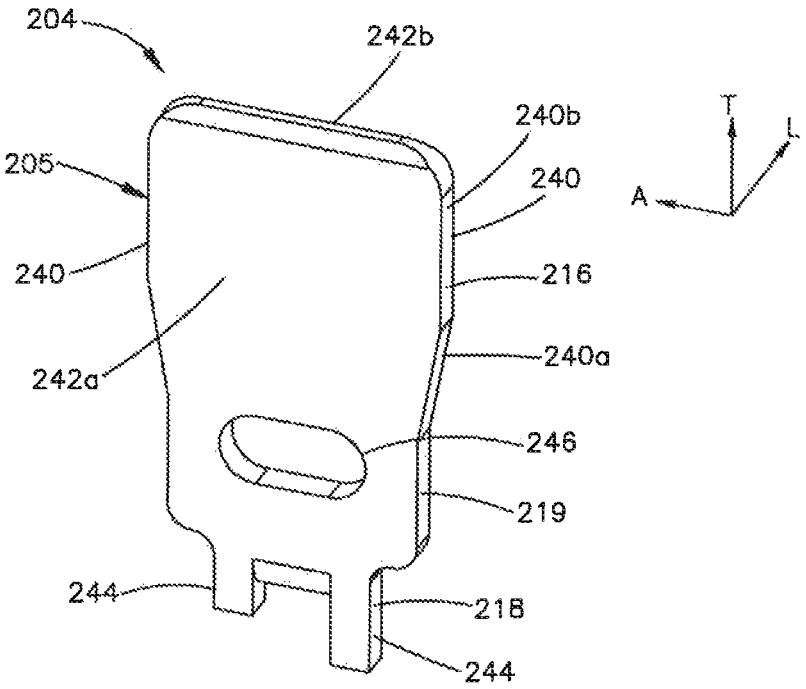
FIG. 5A is a perspective view of one of the electrical contacts illustrated in FIG. 4.
Figure 5B:
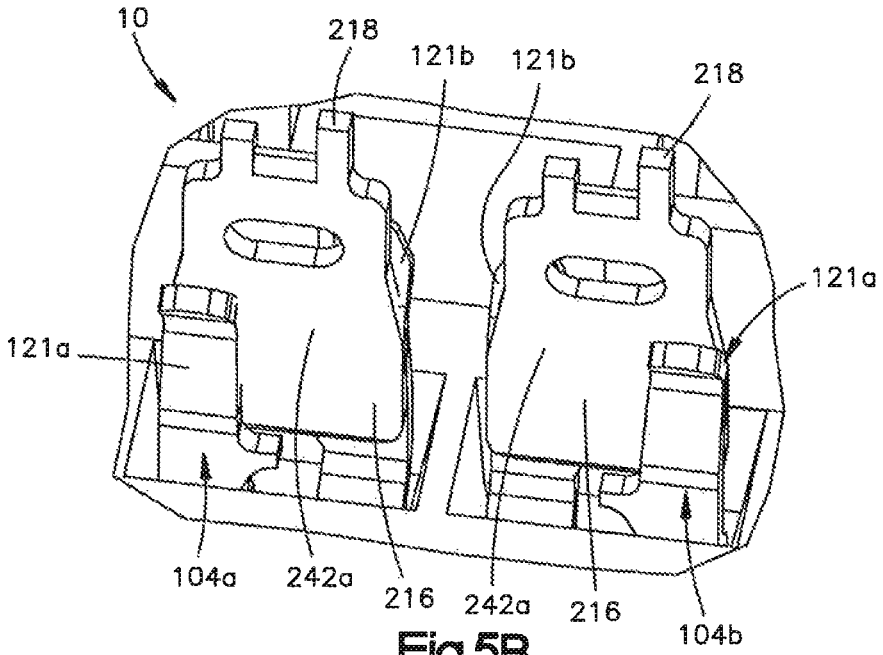
FIG. 5B is a perspective view of a portion of the electrical connector assembly illustrated in FIG. 1, showing the electrical contacts of the first and second electrical connectors mated to each other.

Referring now to FIGS. 1A and 4, the second connector housing 212 can include a base 250 that defines the mounting interface 208, and a plurality of divider walls 252 that project from the base 250 in an outer transverse direction so as to define the mating interface 106. The divider walls 252 can be monolithic with the base 250, or alternatively attached to the base 250 in any manner as desired. The outer transverse direction can be defined as a direction from the mounting interface 208 to the mating interface 206. In this regard, the first electrical connector 100, and the components, thereof, can outer transverse direction defined as a direction from the mounting ends 118 toward the mating ends 116 in the transverse direction T. The divider walls 252 that extend along each of the respective rows are spaced from the divider walls 252 that extend along others of the respective rows are spaced from each other along the longitudinal direction L. Each of the divider walls 252 along a respective one of the rows can include a first plurality of divider walls 252*a* and a second plurality of divider walls 252*b*. Ones of the first plurality of divider walls 252*a* and ones of the second plurality of divider walls 252*b* can be alternatingly arranged with each other along each of the respective rows. Adjacent ones of the divider walls 252 can be spaced from each other along each of the lateral direction A and the longitudinal direction L. Alternatively, adjacent ones of the divider walls 252 can be attached to each other along one or both of the lateral direction A and the longitudinal direction L.

Each of the divider walls 252 can be T-shaped. For example, each of first plurality of divider walls 252*a* can include a first primary wall segment 254 and a first auxiliary wall segment 258. The first primary wall segment 254 extends along at least a portion of the first broadsides 242*a* of a first one 204*a* and a second one 204*b* of the electrical contacts 204. The first end second ones 204*a-b* of the electrical contacts 204 can be adjacent each other along the lateral direction A so as to define a pair of the electrical contacts 204. The first primary wall segment 254 can define a first primary surface 256 that, in turn, can be planar along a respective first plane. The first plane can be oriented along the transverse direction T and the lateral direction A. The first primary surface 256 can face at least a portion of the first broadsides 242*a* of each of the first and second ones 204*a* and 204*b* of the electrical contacts 204 along the longitudinal direction L. For instance, the first primary surface 256 can extend from a first location aligned with the first broadside 242*a* of the first one 204*a* of the electrical contacts 204 with respect to the longitudinal direction at a location laterally between the opposed edges 240, to a second location aligned with the first broadside 242*a* of the second one 204*b* of the electrical contacts 204 with respect to the longitudinal direction at a location laterally between the opposed edges 240. The mating ends 216 can extend in the outer transverse direction with respect to the divider walls 252, or the mating portions 216 can be recessed with respect to the divider walls 252 in the transverse direction. The first primary wall segments 254 of each of the divider walls 252 can be aligned with each other along the lateral direction A. Further, the first primary wall segments 254 of each of the divider walls 252 can be co-linear with each other along the lateral direction A.

The first auxiliary wall segment 258 can extend from the first primary wall segment 254 to a distal end 258*a*. The first auxiliary wall segment 258 can extend between the first and second ones 204*a* and 204*b* of the electrical contacts 204 at a location between the first primary wall segment 254 and the distal end 258*a*. Thus, the distal end 258*a* can be positioned such that each of the first and second ones 204*a* and 204*b* of the electrical contacts are disposed between the distal end 258*a* and the first primary surface 256 with respect to the longitudinal direction L. The first auxiliary wall segments 258 can be oriented so as to extend from the primary wall segment 254 along the longitudinal direction L. Each of the first primary wall segment 254 and the auxiliary wall segment 258 can be coplanar with each other at their respective outermost transverse surfaces. The auxiliary wall segment 258 can longitudinally bifurcate the first primary wall segment 254 into equal halves. Each of the first auxiliary wall segments 258 of the plurality of dividers walls 252 can be aligned with each other along the longitudinal direction L. For instance, each of the first auxiliary wall segments 258 of the plurality of divider walls 252 can be co-linear with each other along the longitudinal direction L.

Each of the second plurality of divider walls 252*b* can include a second primary wall segment 260 and a second auxiliary wall segment 262. The second primary wall segment 260 extends along at least a portion of the second broadsides 242*b* of a select one of the first one 204*a* and the second one 204*b* of the electrical contacts 204, and a third one 204*c* of the electrical contacts 204 that forms a pair of adjacent contacts with the select one of the electrical contacts. Thus, the second primary wall segment extends along at least a portion of the second broadsides 242*b* of a second pair of the electrical contacts 204 that has an electrical contact in common with the first pair of electrical contacts 204. The select one of the electrical contacts 204 and the third one 204*c* of the electrical contacts 204 can be adjacent each other along the lateral direction A so as to define the second pair of the electrical contacts 204. The second primary wall segment 260 can define a second primary surface 264 that, in turn, can be planar along a respective first plane. The first plane can be oriented along the transverse direction T and the lateral direction A. The second primary surface 264 can face a direction opposite the direction that the first primary surface 256 faces along the longitudinal direction L. Further, the second primary surface 264 can face the other of the broadsides 242*a-b* of the select electrical contact 204 along the longitudinal direction L, with respect to the one of the broadsides 242*a-b* that the first primary surface 256 faces, and the same facing broadside of the third electrical contact 204*c*. For instance, the second primary surface 264 can extend from a first location aligned with the second broadside 242*b* of the select one of the electrical contacts 204 with respect to the longitudinal direction L at a location laterally between the opposed edges 240, to a second location aligned with the second broadside 242*b* of the third one 204*c* of the electrical contacts 204 with respect to the longitudinal direction L at a location laterally between the opposed edges 240. The second primary wall segments 260 of each of the divider walls 252 can be aligned with each other along the lateral direction A. Further, the second primary wall segments 260 of each of the divider walls 252 can be co-linear with each other along the lateral direction A.

The second auxiliary wall segment 262 can extend from the second primary wall segment 260 to a distal end 262*a*. The second auxiliary wall segment 262 can extend between the select one of the electrical contacts 204 and the third one 204*c* of the electrical contacts 204 at a location between the second primary wall segment 260 and the distal end 262*a*. Thus, the distal end 262*a* can be positioned such that each of the select one of the electrical contacts 204 and the third one 204*c* of the electrical contacts 204 are disposed between the distal end 262*a* and the second primary surface 264 with respect to the longitudinal direction L. The second auxiliary wall segments 262 can be oriented so as to extend from the second primary wall segment 260 along the longitudinal direction L. Each of the second auxiliary wall segments 262 of the plurality of divider walls 252 can be aligned with each other along the longitudinal direction. For instance, each of the second auxiliary wall segments 262 of the plurality of divider walls 252 can be co-linear with each other along the longitudinal direction L.

It should thus be appreciated that the first plurality 252*a* of divider walls 252 and the second plurality 252*b* of divider walls 252 can be T-shaped and oriented in opposite directions with respect to each other. Further, the second connector housing 212 can include a plurality of projections 270 that extend at least into, or through, respective ones of the apertures 246 of the plurality of electrical contacts 204. The projections 270 can extend out from any portion of the second connector housing 212 as desired. For instance, the projections 270 can extend out from one or both of the first and second pluralities 252*a* and 252*b* of the divider walls 252. In one example, one or more up to all of the projections 270 can extend from the first primary wall segments 254. For instance, the projections 270 can extend from opposed ends of the first primary wall segments 254, and in particular from the first primary surface 256. Alternatively or additionally, one or more up to all of the projections 270 can extend from the second primary wall segments 260. For instance, the projections 270 can extend from opposed ends of the second primary wall segments 260, and in particular from the second primary surface 264.

As described above with respect to the first and second housings 112 and 212, the electrical contacts 104 of the first array 102 of electrical contacts 104 of the first electrical connector 100 are supported by the connector housing 112 substantially along the transverse direction T, such that the mating ends 116 can be recessed with respect to the inner end 114*e* of the housing body 114, and the mounting ends 118 at least partially protrude from the outer end 114*f* of the housing body 114. Alternatively, the mating ends 116 can be coplanar with the inner end 114*e* of the housing body 114. Alternatively still, the mating ends 116 can at least partially protrude from the inner end 114*e* of the housing body 114. Similarly, the electrical contacts 204 of the second array 202 of electrical contacts 204 of the second electrical connector 200 are supported by the connector housing 212 substantially along the transverse direction T, such that the mating ends 216 at least partially protrude from the inner end 214*e* of the housing body 214 and the mounting ends 218, at least partially protrude from the outer end 214*f* of the housing body 214. Alternatively, the mating ends 216 can be coplanar with the inner end 214*e* of the housing body 214. Alternatively still, the mating ends 216 can be recessed with respect to the inner end 214*e* of the housing body 214.

It should be appreciated that the first and second connector housings 112 and 212 have been described in accordance with one embodiment, and that each of the first and second connector housings 112 and 212 can be constructed in accordance with any suitable alternative embodiment as desired. For instance, the divider walls 152 of the first connector housing 112 can be alternatively shaped as desired. As one example, the divider walls 152 can define one or more straight walls along each of the rows or columns of electrical contacts. Similarly, the divider walls 252 of the second connector housing 212 can be alternatively shaped as desired. As one example, the divider walls 252 can define one or more straight walls along each of the rows or columns of electrical contacts.

Referring again to FIGS. 1A-1C, the mounting ends 118 of the electrical contacts can be configured such that the first electrical connector 100 can be mounted to a complementary electrical component, for instance the first printed circuit board as described above. For example, in accordance with the illustrated embodiment, the mounting end of each electrical contact 104 can include a fusible element, such as a solder ball 122 that is disposed at the mounting end 118 of the contact body 105, for instance fused to the mounting end 118. For instance, the solder balls 122 can be supported by the projections of the mounting end 118. The solder balls 122 can all be co-planar with each other along the mounting interface 108 both before and after a solder reflow process, described below, is completed. The solder ball 122 can be integral and monolithic with the contact body of the electrical contact 104 or can be separate and attached to the mounting end 118. It should be appreciated that the solder balls 122 of the electrical contacts 104 can be mounted to corresponding electrical contacts, for instance electrically conductive contact pads of the first printed circuit board, for instance by positioning the first electrical connector 100 on the first printed circuit board and subjecting the first electrical connector 100 and the first printed circuit board to a solder reflow process whereby the solder balls 122 fuse to the contact pads of the respective printed circuit board. It should further be appreciated that the electrical contacts 104 are not limited to the illustrated mounting ends 118, and that the mounting ends 118 can be alternatively configured with any other suitable fusible or non-fusible element as desired, such as press-fit mounting tails configured to be inserted into complementary vias of the first printed circuit board.

The mounting ends 218 of the electrical contacts 204 can be configured such that the second electrical connector 200 can be mounted to a complementary electrical component, for instance the second printed circuit board as described above. For example, in accordance with the illustrated embodiment, the mounting end of each electrical contact 204 can include a fusible element, such as a solder ball 222 that is disposed at the mounting end 218 of the contact body 205, for instance fused to the mounting end 218. For instance, the solder balls 222 can be supported by the projections 244 of the mounting end 218. The solder ball 222 can be integral and monolithic with the contact body of the electrical contact 204 or can be separate and attached to the mounting end 218. The solder balls 222 can all be co-planar with each other along the mounting interface 208 both before and after the solder reflow process is completed. It should be appreciated that the solder balls 222 of the electrical contacts 204 can be mounted to corresponding electrical contacts, for instance electrically conductive contact pads of the first printed circuit board, for instance by positioning the second electrical connector 200 on the second printed circuit board and subjecting the second electrical connector 200 and the second printed circuit board to a solder reflow process whereby the solder balls fuse to the contact pads of the respective printed circuit board. It should further be appreciated that the electrical contacts 204 are not limited to the illustrated mounting ends 218 and that the mounting ends 218 can be alternatively configured with any other suitable fusible or non-fusible element as desired, such as press-fit mounting tails configured to be inserted into complementary vias of the second printed circuit board. All of the solder balls 222 at the mounting ends of the second electrical connector 200 are coplanar with each other in a second plane, both before and after the solder balls 222 are reflowed to the second printed circuit board so as to mount the second electrical connector 200 to the second printed circuit board.

In accordance with the illustrated embodiment, the electrical contacts 104 of the first array 102 of electrical contacts 104 of the first electrical connector 100 are supported by the connector housing 112 substantially along the transverse direction T, such that the mating ends 116 are recessed with respect to the inner end 114*e* of the housing body 114, and the mounting ends 118 at least partially protrude from the outer end 114*f* of the housing body 114. Similarly, the electrical contacts 204 of the second array 202 of electrical contacts 204 of the second electrical connector 200 are supported by the connector housing 212 substantially along the transverse direction T, such that the mating ends 216 at least partially protrude from the inner end 214*e* of the housing body 214 and the mounting ends 218, at least partially protrude from the outer end 214*f* of the housing body 214.

Figure 1C:
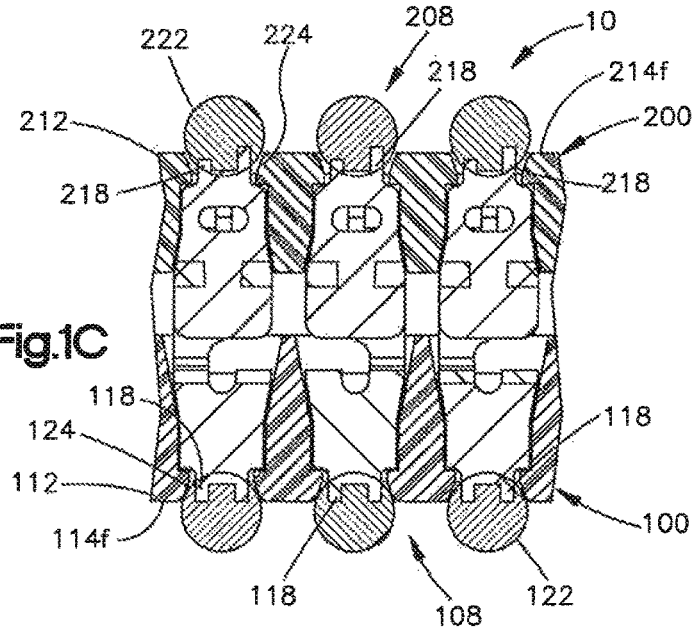
FIG. 1C is a sectional side elevation view of respective portions of the first and second electrical connectors illustrated in FIG. 1A.

With continuing reference to FIGS. 1A-1C, the first electrical connector 100 can define a plurality of pockets 124 that extend into the housing body 114 along the transverse direction T. For instance, the pockets 124 can extend into the outer end 114*f* of the housing body 114 of the connector housing 112 along the transverse direction T toward the inner end 114*e*. The opposed mounting ends 118 of the contact body 105 can extend into the pockets 124. Each of the pockets 124 can be configured to at least partially receive a respective one of the solder balls 122 of the electrical contacts 104. Accordingly, the mounting ends of each of the electrical contacts 104, which can include the mounting ends 118 of the contact body 105 and the respective solder ball 122 can be at least partially disposed in the pockets 124. Thus, when the first array 102 of electrical contacts 104 is supported by the connector housing 112, each solder ball 122 is at least partially recessed with respect to the outer end 114*f* of the housing body 114, in a respective one of the plurality of pockets 124. In this regard, it can be said that the solder balls 122 of the first array 102 of electrical contacts 104 protrude out with respect to the outer end 114*f* of the housing body 114.

The connector housing 212 can define a plurality of pockets 224 that extend into the housing body 214 along the transverse direction T. For instance, the pockets 224 can extend into the outer end 214*f* of the housing body 214 along the transverse direction T toward the inner end 214*e*. The opposed mounting ends 218 of the contact body 205 can extend into the pockets 224. Each of the pockets 224 can be configured to at least partially receive a respective one of the solder balls 222. Accordingly, the mounting ends of each of the electrical contacts 204, which can include the mounting ends 218 of the contact body 205 and the respective solder ball 222, can be at least partially disposed in the respective pockets 224. Thus, when the second array 202 of electrical contacts 104 is supported by the connector housing 212, each solder ball 222 is at least partially recessed with respect to the outer end 214*f* of the housing body 214, in a respective one of the plurality of pockets 224. In this regard, it can be said that the solder balls 222 of the second array 202 of electrical contacts 204 protrude out with respect to the outer end 214*f* of the housing body 214.

The first and second electrical connectors 100 and 200 can be mated to each other in a mating direction M that can be defined by the transverse direction T, and unmated from each other in a direction opposite the mating direction. As the first and second electrical connectors 100 and 200 are mated, respective alignment members of the electrical connectors can engage each other when the first and second electrical connectors 100 and 200 are in a predetermined relative orientation so as to align the first and second electrical connectors 100 and 200 relative to each other, thereby aligning the first array 102 of electrical contacts 104 of the first electrical connector 100 with the second array 202 of electrical contacts 204 of the second electrical connector 200. For instance, side walls 114*a* and 114*b* of the housing body 114 of the first electrical connector 100 can engage with corresponding side walls of the housing body 214 of the connector housing 212 of the second electrical connector 200 so as to align the respective connector housings 112 and 212 of the first and second electrical connectors 100 and 200 relative to each other along one or both of the longitudinal direction L and the lateral direction A.

When the first and second electrical connectors 100 and 200 are fully mated to each other, the mating end 216 of each electrical contact 204 of the second array 202 makes at least a first point of contact on the first arm 121*a* of a respective one of the first electrical contacts 104 of the first array 102, and a second point of contact on the second arm 121*b* of the respective one of the first electrical contacts 104 of the first array 102. As described above the first point of contact can be defined by the first convex surface 125*b*, and the second point of contact can be defined by the second convex surface 127*b*. Moreover, when the first and second electrical connectors 100 and 200 are configured as mezzanine connectors, the electrical connector assembly 10 when fully mated, exhibits a stack height, for instance as defined by a distance along the transverse direction T between respective locations on the solder balls 122 of the electrical contacts 104 of the first array 102 that are spaced furthest from the inner end 114*e* of the housing body 114 of the connector housing 112 of the first electrical connector 100 and respective locations on the solder balls 222 of the electrical contacts 204 of the second array 202 that are spaced furthest from the inner end 214*e* of the housing body 214 of the connector housing 212 of the second electrical connector 200. Otherwise stated, the stack height can be defined by opposed outermost ends, along the transverse direction T, of the reflowed solder balls 122 of the first electrical connector 100 and the reflowed solder balls 222 of the second electrical connector 200. In accordance with the illustrated embodiment, the stack height of the electrical connector assembly 10, that is the cumulative height of the first and second electrical connectors 102 and 202 along the transverse direction T when mated, can be in a range having a lower end between and including approximately 1 mm and approximately 2 mm, and increments of 0.1 mm therebetween. The range can have an upper end between and including approximately 2 mm and approximately 10 mm, and increments of 0.1 mm therebetween. For instance, the stack height can be approximately 2 mm. The stack height can further be approximately 3 mm, 4 mm, 5 mm, 6 mm, 7 mm, 8 mm, 9 mm, or 10 mm. In this regard, it can be said that when the first and second electrical connectors 100 and 200 are mated to each other, each fusible element of the first array 102 of electrical contacts 104 is spaced from a corresponding fusible element of the second array 202 of electrical contacts 204 a distance equal to the stack height along the transverse direction T.

It should be noted that the illustrations and discussions of the embodiments shown in the figures are for exemplary purposes only, and should not be construed limiting the disclosure. One skilled in the art will appreciate that the present disclosure contemplates various embodiments. Additionally, it should be understood that the concepts described above with the above-described embodiments may be employed alone or in combination with any of the other embodiments described above. It should further be appreciated that the various alternative embodiments described above with respect to one illustrated embodiment can apply to all embodiments as described herein, unless otherwise indicated.

What is claimed:

1. An electrical contact comprising:

a lead portion;

a mounting end that extends from the lead portion in a first transverse direction along a transverse direction; and a mating end that extends from the lead portion in a second transverse direction that is opposite the first transverse direction, wherein the mating end includes first and second arms that are spaced from each other along a lateral direction that is perpendicular to the transverse direction, wherein the mating end defines a first projection that extends from the first arm in a first lateral direction along the lateral direction, and a second projection that extends from the second arm in a second lateral direction that is opposite the first lateral direction, and the first and second projections are sized and configured to receive an insertion force that drives the electrical contact into a dielectric connector housing so as to secure the electrical contact in the connector housing, wherein at least a portion of the electrical contact defines a pair of opposed outer edges and a pair of opposed broadsides that are longer than the opposed edges;

wherein the first projection extends out from an inner edge of the first arm opposite one of the outer edges of the electrical contact at the first arm;

wherein the second projection extends out from an inner edge of the second arm opposite the other of the outer edges of the electrical contact at the second arm; and wherein the first and second projections are disposed closer to a first point at which the first and second arms meet, along the transverse direction, than to a second point at which at least one of the first and second arms terminates.

2. The electrical contact as recited in claim 1, wherein the first and second projections extend out from the first and second arms, respectively, an equal distance along the lateral direction.

3. The electrical contact as recited in claim 1, wherein at least a portion of the first and second projections is offset with respect to each other along a longitudinal direction that is perpendicular to each of the lateral and transverse direction.

4. The electrical contact as recited in claim 1, wherein at least a portion of the first and second projections is offset with respect to each other along the transverse direction T.

5. The electrical contact as recited in claim 1, wherein the first arm is curved in a direction opposite the second arm.

6. The electrical contact as recited in claim 5, wherein the first arm defines a first concave surface and a first convex surface opposite the first concave surface along a longitudinal direction that is perpendicular to each of the lateral direction and the transverse direction.

7. The electrical contact as recited in claim 6, wherein the second arm defines a second concave surface and a second convex surface opposite the second concave surface along the longitudinal direction.

8. The electrical contact as recited in claim 7, wherein the first concave surface faces a first longitudinal direction along the longitudinal direction, and the second concave surface faces a second longitudinal direction that is opposite the first longitudinal direction.

9. The electrical contact as recited in claim 8, wherein the first arm defines a first tip that is tapered along the lateral direction, and the second arm defines a second tip that is tapered along the lateral direction.

10. The electrical contact as recited in claim 9, wherein one of the outer edges at the first arm between the lead portion and the first tip is planar along a first plane that includes the transverse direction and the longitudinal direction, and the other of the outer edges at the second arm between the lead portion and the second tip is planar along a second plane that includes the transverse direction and the longitudinal direction.

11. The electrical contact as recited in claim 1, wherein the mounting ends are configured to support respective ones of a plurality of solder balls.

12. An electrical connector, comprising:

a dielectric or electrically insulative electrical connector housing comprising:

a base that defines a mounting interface of the connector;

a plurality of divider walls that project from the base in a transverse direction so as to define a mating interface of the connector, the plurality of divider walls defining a plurality of rows that each extends along a lateral direction perpendicular to the transverse direction, wherein ones of the plurality of rows are spaced from each other along a longitudinal direction that is perpendicular to both the transverse direction and the lateral direction, wherein each of the plurality of divider walls includes:

a plurality of first wall segments spaced from each other along the lateral direction;

a plurality of second wall segments spaced from each other along the lateral direction, wherein the first wall segments are offset with respect to the second wall segments in the longitudinal direction; and a plurality of ribs that are each connected between a respective one of the plurality of first wall segments and a respective one of the plurality of second wall segments; and a plurality of electrical contacts supported by the connector housing, wherein each of the plurality of electrical contacts comprises:

a lead portion;

and a mating end that extends from the lead portion, wherein the mating end includes first and second arms that are spaced from each other along the lateral direction, wherein the plurality of electrical contacts are disposed along the rows such that each row comprises at least a first electrical contact, a second electrical contact and a third electrical contact, with the second electrical contact disposed between the first and third electrical contacts, and wherein within each row:

the second arm of the first electrical contact is adjacent to and aligned with the first arm of the second electrical contact along the lateral direction, and the second arm of the second electrical contact is adjacent to and aligned with the first arm of the third electrical contact along the lateral direction, and the first and second arms of each of the first and second electrical contacts are offset from each other in a direction perpendicular to the lateral direction.

13. The connector as recited in claim 12, wherein each of the first and second wall segments defines a respective first end and a respective second end opposite respective the first end, and each of the ribs extends from the first end of one of the first and second wall segments to the second end of one of the other of the first and second wall segments.

14. The connector as recited in claim 13, wherein each of a first plurality of the ribs extends from the first end of a respective one of the first wall segments to the second end of a respective one of the second wall segments.

15. The connector as recited in claim 14, wherein each of a second plurality of the ribs extends from the second end of a respective one of the first wall segments to the first end of a respective one of the second wall segments.

16. The connector as recited in claim 15, wherein the first ends of the first wall segments are aligned with the second ends of the second wall segments along the longitudinal direction L.

17. The connector as recited in claim 16, wherein the second ends of the first wall segments are aligned with the first ends of the second wall segments along the longitudinal direction.

18. The connector as recited in claim 17, wherein each of the ribs lies in a respective plane that is defined by the transverse direction and the longitudinal direction.

19. The electrical connector as recited in claim 12, wherein the mating end of each contact defines a first projection that extends from the first arm in a first lateral direction along the lateral direction, and a second projection that extends from the second arm in a second lateral direction that is opposite the first lateral direction, and the first and second projections are sized and configured to receive an insertion force that drives the electrical contact into a dielectric connector housing so as to secure the electrical contact in the connector housing.

20. The electrical connector as recited in claim 19, wherein the plurality of electrical contacts are further arranged in a plurality of columns that are each oriented along the longitudinal direction.

21. The electrical connector as recited in claim 19, wherein the edges of repeating first and second ones of the electrical contacts can be aligned with each other along a respective one of the rows, such that the electrical contacts define alternating mirror images of each other along the respective one of the rows.

22. The electrical connector as recited in claim 19, wherein pairs of the first and second ones of the electrical contacts are edge coupled with each other.

23. The electrical connector as recited in claim 12, wherein:

the first arm of the first electrical contact is adjacent a first wall segment;

the second arm of the first electrical contact and the first arm of the second electrical contact are adjacent a second wall segment;

the second arm of the second electrical contact and the first arm of the third electrical contact are adjacent a first wall segment; and the second arm of the third electrical contact are adjacent a second wall segment.

24. An electrical contact comprising:

a lead portion;

a mounting end that extends from the lead portion in a first transverse direction along a first transverse direction; and a paddle shaped mating end that extends from the lead portion in a second transverse direction that is opposite the first transverse direction, wherein the electrical contact comprises a pair of opposed edges and a pair of first and second opposed broadsides joining the opposed edges and that are longer than the opposed edges, wherein each of the broadsides is substantially planar at the mating end and provides a mating contact surface, and the edges flare away from each other over at least a portion of a length of the edges such that the broadsides are wider at the mating end than at the mounting end;

wherein the mating end comprises an outer transverse portion spaced from an intermediate transverse portion in the second transverse direction, and an inner transverse portion spaced from the intermediate transverse portion in the first transverse direction, wherein the opposed edges at the intermediate transverse portion diverge from each other, as they extend in the second transverse direction, an amount greater than a first amount that the opposed edges at the inner transverse portion diverge from each other, and greater than a second amount that the opposed edges at the outer transverse portion diverge from each other, as they extend in the second transverse direction.

25. The electrical contact as recited in claim 24, wherein the opposed edges at the intermediate transverse portion flare away from each other as they extend in the outer transverse direction, and the opposed edges at both the outer and inner transverse portions are each parallel to each other at the opposed edges.

26. The electrical contact as recited in claim 25, wherein the lead portion defines an aperture that extends therethrough.

27. The electrical contact as recited claim 24, further comprising a second electrical contact with which it mates, wherein:

the second electrical contact comprises:

a lead portion;

a mounting end that extends from the lead portion in a first transverse direction along a transverse direction; and a mating end that extends from the lead portion in a second transverse direction that is opposite the first transverse direction, wherein the mating end includes first and second arms that are spaced from each other along a lateral direction that is perpendicular to the transverse direction, wherein the mating end defines a first projection that extends from the first arm in a first lateral direction along the lateral direction, and a second projection that extends from the second arm in a second lateral direction that is opposite the first lateral direction, and the first and second projections are sized and configured to receive an insertion force that drives the electrical contact into a dielectric connector housing so as to secure the electrical contact in the connector housing, wherein the first arm is curved, and the second arm is curved in a direction opposite the first arm, such that (1) the first arm defines a first concave surface and a first convex surface opposite the first concave surface along a longitudinal direction that is perpendicular to each of the lateral and transverse directions, and (2) the second arm defines a second concave surface and a second convex surface opposite the second concave surface along the longitudinal direction; and wherein the electrical contact is further configured such that one of the opposed broadsides of the electrical contact touches one of the first and second convex surfaces of the second electrical contact, and the other of the opposed broadsides of the electrical contact touches the other of the first and second convex surfaces of the second electrical contact.

* * * * *